United States Patent [19]

Danig

[11] Patent Number: 5,007,247

[45] Date of Patent: Apr. 16, 1991

[54] REFRIGERATION OR HEAT PUMP INSTALLATION

[75] Inventor: Per Danig, Holte, Denmark

[73] Assignee: Danfoss A/S, Nordborg, Denmark

[21] Appl. No.: 411,880

[22] Filed: Sep. 25, 1989

[30] Foreign Application Priority Data

Sep. 30, 1988 [DE] Fed. Rep. of Germany ..... 3833209

[51] Int. Cl.[5] ..... F25B 41/00

[52] U.S. Cl. ..... 62/174; 62/512

[58] Field of Search ..... 62/512, 224, 174

[56] References Cited

U.S. PATENT DOCUMENTS 3,827,249 8/1974 Garland et al. ..... 62/512 X 3,848,425 11/1974 Watkins ..... 62/512 X

*Primary Examiner*—William E. Wayner

*Attorney, Agent, or Firm*—Wayne B. Easton; Clayton R. Johnson

[57] ABSTRACT

The refrigeration or heat pump installation includes a liquid separator that has a vapor chamber having a port connected to the outlet of the evaporator and an outlet connected through a suction conduit to a compressor. The separator also has an intermediate chamber beneath the vapor chamber for receiving liquid from the vapor chamber by the way of a first switching valve, the intermediate chamber being connected to the inlet of the evaporator for the purpose of recirculating liquid. A second switching valve forms part of the expansion apparatus for controlling the flow of fluid either directly to the intermediate chamber or through the first switching valve to the intermediate chamber. The two switching valves are operated to open and closed conditions in the opposite sense for controlling and almost continuous pulsating recirculation of liquid through the evaporator. The expansion apparatus is connected through a condenser to the outlet of the compressor.

16 Claims, 2 Drawing Sheets

Figure 6:
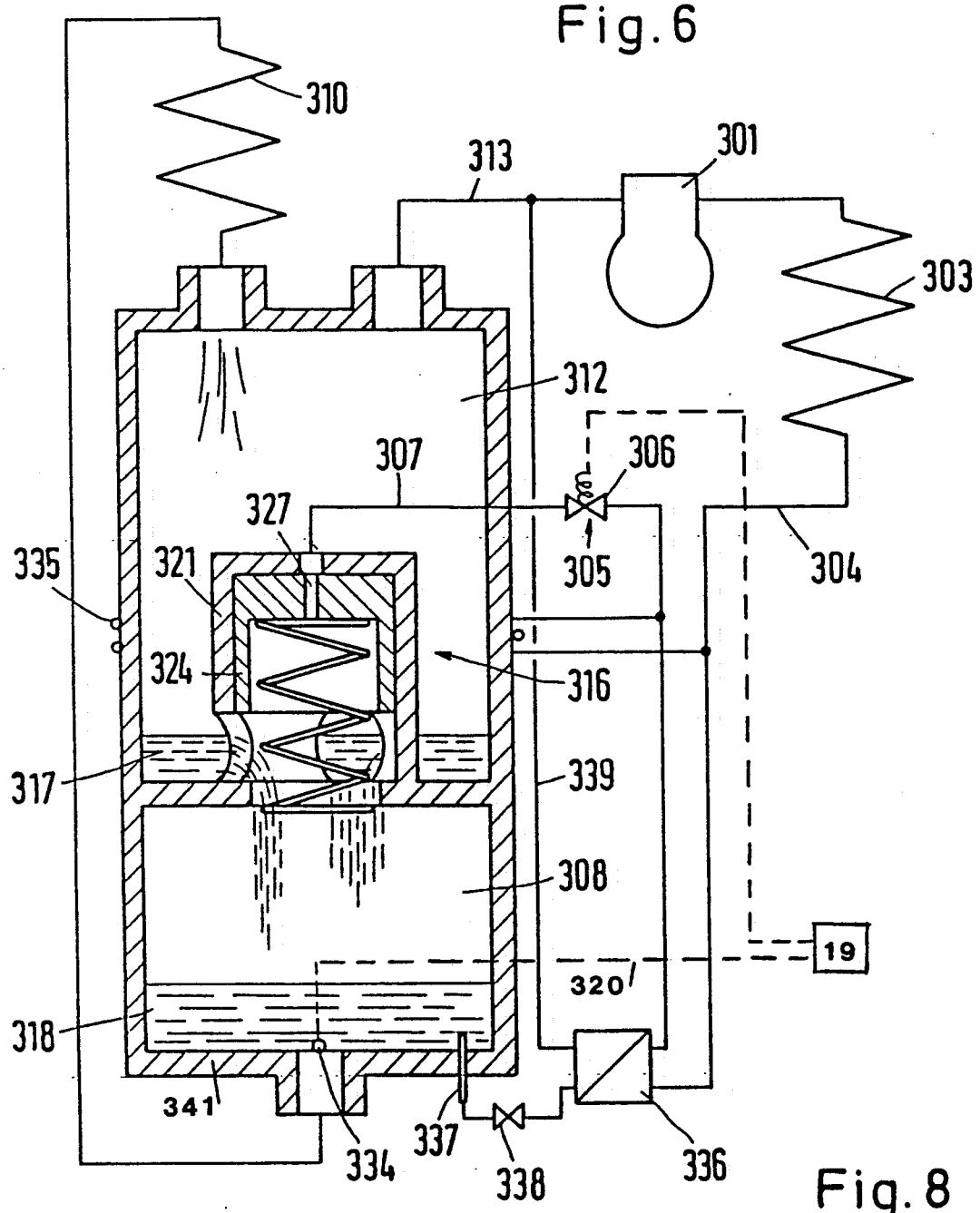

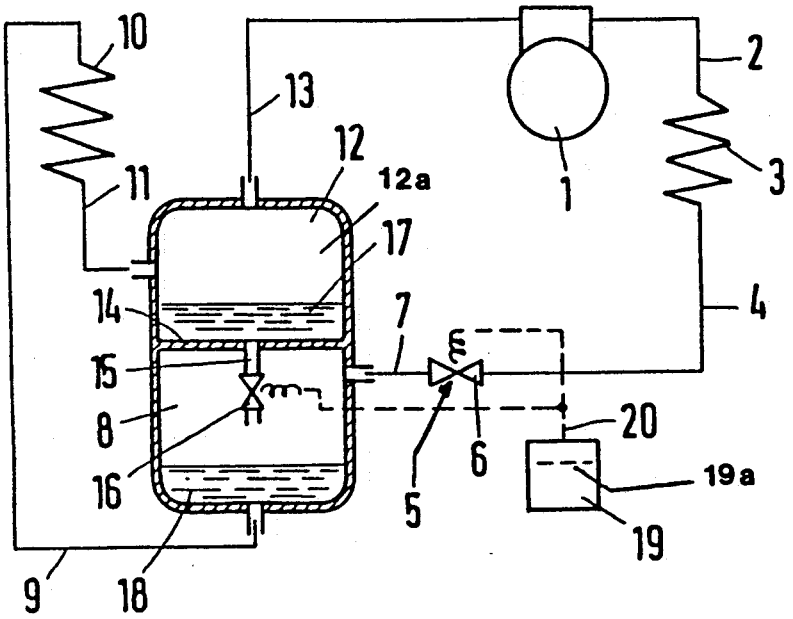
Fig.1
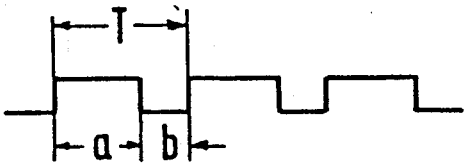
Fig. 2
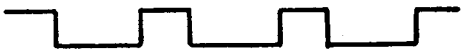
Fig. 3
Fig.4
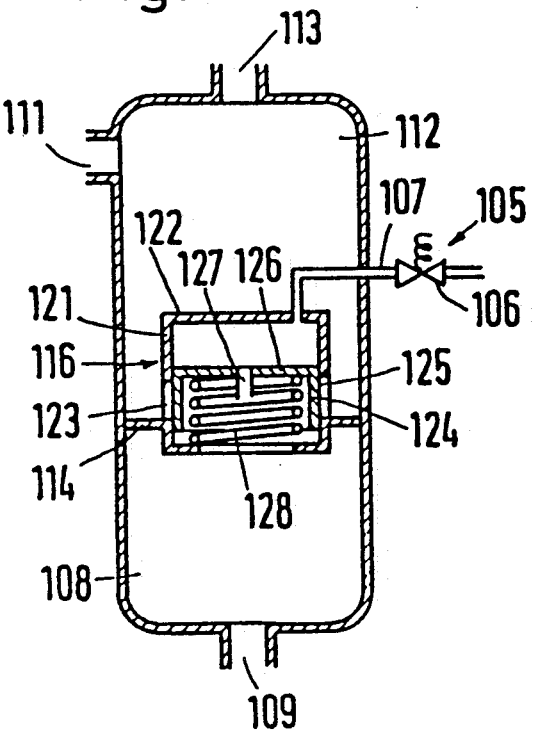
Fig.5
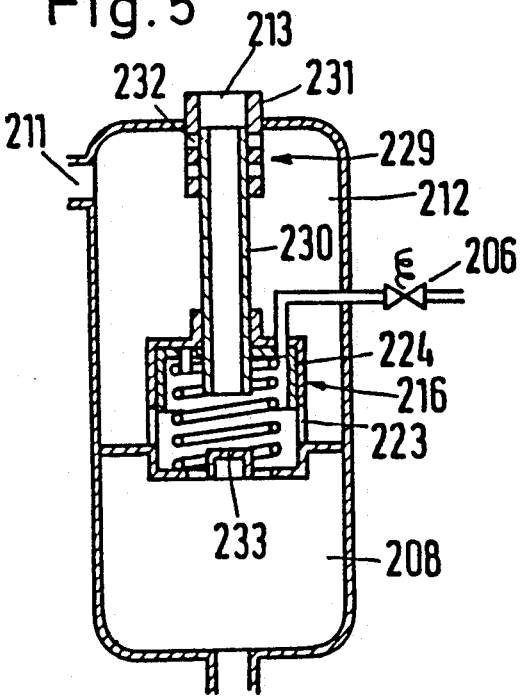

REFRIGERATION OR HEAT PUMP INSTALLATION

The invention relates to a refrigeration or heat pump installation comprising a series circuit of at least one compressor, a condenser, an expansion apparatus with associated valve and an evaporator, also comprising a liquid separator of which the vapour chamber is connected on one side to the evaporator outlet and on the other side to the suction side of the compressor, and comprising an intermediate chamber therebelow, which chamber can be fed by way of a first switching valve with liquid from the liquid separator and is connected to the evaporator for the purpose of recirculating the liquid.

In a known installation of this kind (DE-OS 35 11 829), the evaporator is fed with liquid refrigerant in a manner such that the latter can trickle down the evaporator walls as a film. The unevaporated refrigerant is collected in the liquid separator disposed below the evaporator and is emptied into the intermediate chamber during the stand-still periods of the compressor with the aid of the first switching valve. The outlet of the intermediate chamber is connected by way of a check-valve to the refrigerant conduit behind the expansion apparatus which leads to an injector apparatus in an atomising chamber located above the evaporator. The injector apparatus is fed with drive vapour from the pressure side of the compressor by way of a magnetic valve. This results in uncontrollable recirculation of the liquid refrigerant. A refrigeration plant is also known (Danfoss Catalogue "Automatic controls for industrial refrigeration plants", Printing Reference KA.00.K1.02, Page 1) in which a liquid separator receives the refrigerant from the expansion apparatus as well as the refrigerant from the evaporators. The liquid chamber of this separator is connected to the evaporator inlets by way of pumps and additional equipment such as regulators and expansion valves. With the aid of the pumps, one can accurately dispense the liquid refrigerant to be supplied to the evaporators. The operation of the evaporator can be optomised, particularly with regard to a low mean temperature difference. However, this plant is expensive and complicated.

The invention is based on the problem of providing a refrigeration or heat pump installation of the aforementioned kind in which the quantity of liquid refrigerant passing through the evaporator is adjustable in a simple and cheap manner over a wide operating range.

This problem is solved according to the invention in that the valve of the expansion apparatus is a second switching valve, that the two switching valves can be brought to the open and closed condition in opposite senses, and that the outlet of the expansion apparatus is connected to the intermediate chamber.

In this installation, the divided liquid refrigerant is, whenever the second switching valve is closed, emptied into the intermediate chamber by way of the first switching valve and from there, when the second switching valve is opened, fed to the evaporator again under the pressure of the refrigerant vapour created during expansion. By selecting the respective opening and closing periods, one obtains controlled and practically continuous pulsating recirculation and an improved thermal transmission coefficient k of the evaporator corresponding to the recirculation. Thus, for the same refrigeration effect, one can reduce the evaporator surface and/or operate at a lower mean temperature difference, i.e. at a suction pressure of the compressor having a higher absolute value and thus achieve a saving in energy. Since recirculation achieves a lower mean temperature difference and practically the same temperature over the entire evaporator surface because the entire evaporator surface is covered with liquid, less drying out of the refrigerated goods is obtained in refrigeration plants in conjunction with this smaller mean temperature difference. In particular, an optimum k value for the evaporator can be achieved even if one works with a low recirculation number and small filling. The arrangement can be employed in conjunction with the most varied standard types of evaporator and refrigerant.

It is particularly favourable to provide a pulse width modulation control apparatus at least for the second switching valve. This permits very good regulation by altering the ratio of the opening and closing periods in a respective predetermined cycle period. This permits the quantities of the liquid refrigerant newly fed through the expansion apparatus and the recirculating liquid refrigerant to be readily set taking the nature of the plant, operating conditions, evaporator load etc. into account. Such a control can be readily embodied by means of an electronic control circuit.

It is also favourable for the switching valves to be operable during short opening and closing times in comparison with the switching periods of the compressor. The thereby rapidly pulsating liquid flow has a favourable effect on the thermal transmission coefficient k of the evaporator. In particular, a short total cycle period for the pulse width modulation control apparatus comes into consideration which is less than 60 s, preferably less than 30 s. Consequently, the conditions in the evaporator remain practically constant despite the pulsating supply of the liquid refrigerant.

In a preferred embodiment, the second switching valve is a pulse width-modulated magnetic valve.

The first switching valve can likewise be a pulse width-modulated magnetic valve operable by means of the same or inverted control pulses as the second switching valve.

Alternatively, the first switching valve is controlled in dependence on the refrigerant pressure behind the expansion apparatus. Since the refrigerant pressure depends on the opening condition of the second switching valve, the first switching valve is operated for the same period.

It is in this case advisable for the first switching valve to comprise a piston which is biased in the opening direction by a return spring and in the closing direction by the pressure drop at a throttle through which the refrigerant passes. This results in a particularly simple construction.

In a further embodiment, the piston is pot-shaped and disposed in a cylinder at the base of the liquid separator, the cylinder having valve apertures and being provided with a covering wall, wherein the throttle is formed in the base of the pot, the return spring projects into the interior of the pot and the valve apertures are overcontrolled by the walls of the pot. All the important elements are brought together in the pot-shaped piston and the cylinder surrounding same.

In many cases, a third switching valve is recommended which, when the first switching valve is closed, substantially connects the vapour chamber of the liquid separator to the suction side of the compressor and, when the first switching valve is open, substantially connects the vapour chamber of the intermediate chamber to the suction side of the compressor. This ensures that no refrigerant vapour flows from the intermediate chamber in a direction opposite to the liquid flowing off through the valve apertures of the first switching valve and thereby impeding the flowing off. One can thereby reduce the flowing off period and thus the opening time for the first switching valve. The third switching valve need not close in its switching positions because the desired effect is still obtained, even though to a lesser extent.

It is particularly simple if the closure members of the first and third switching valves are mechanically interconnected.

This can be achieved particularly in that a valve tube is connected to the piston and passes therethrough and engages in a valve sleeve which precedes the outlet leading to the compressor and has apertures over-controllable by the valve tube.

It is also advantageous to have a sensor at the base of the intermediate chamber detecting the transition of liquid from the two phase liquid-vapour condition and, in dependence thereon, influencing the control of the switching valves. This sensor detects the emptying time of the intermediate chamber, which is decisive for the recirculating period and the control of the switching valves.

Since the pressure in the intermediate chamber also changes during emptying, the intermediate chamber may likewise contain a pressure sensor which influences the control of the switching valves when the pressure falls below a pressure threshold.

Further, a heat exchanger in the vicinity of the liquid separator may have its primary side upstream of the expansion apparatus. Since a certain amount of evaporation takes place in this region, refrigeration takes place of the refrigerant liquid to be fed to the expansion apparatus, thus achieving a higher efficiency.

In particular, the heat exchanger may be formed by tube connections of the refrigerant conduit at the periphery of the liquid separator.

In another embodiment, there is a conduit which leads to the suction side of the compressor by way of a throttle passage at the base of the intermediate chamber, an expansion valve and the secondary side of a heat exchanger, the primary side of the heat exchanger preceding the expansion apparatus. In this way, oil in the circulating refrigerant can be led away. Refrigerant mixed with the oil is expanded in the expansion valve and subsequently evaporated in the heat exchanger.

It is particularly favourable if the rate of recirculation of the refrigerant is about 1.2 to 1.5. In this range, one obtains an adequately increased k value of the evaporator. On the other hand, the liquid separator can be kept comparatively small.

It is also recommended that a liquid distributor be arranged in one piece with the outlet of the intermediate chamber, the outlets of the distributor each being connected to one evaporator branch. Since liquid may appear at the outlet of the evaporator, there will be fewer problems with the refrigerant distribution in the individual parallel passages of the evaporator than is known for dry evaporators which must operate with a certain amount of overheating control of the expansion valve and in which special measures are necessary to achieve uniform distribution of the refrigerant liquid to the individual tube coils of the evaporator. Accordingly, different distributors are required for each type of evaporator depending on the application. According to the invention, however, the intermediate chamber and distributor form a prefabricated constructional unit so that assembly is considerably simplified.

Figure 7:
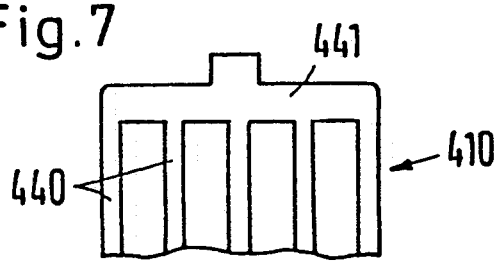
Figure 8:
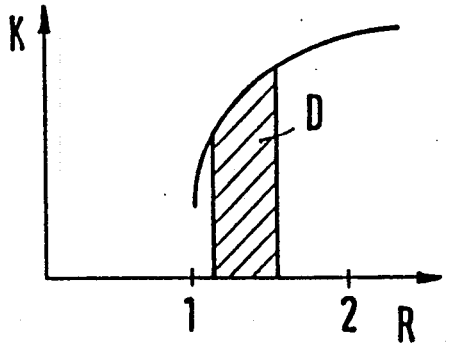

Preferred examples of the invention will now be described in more detail with reference to the drawing, wherein:

FIG. 1 is a diagrammatic illustration of an installation according to the invention, FIG. 2 shows the position of one of the switching valves against time, FIG. 3 shows the position of the other switching valve against time, FIG. 4 is a partial view of a modified embodiment, FIG. 5 is a partial view of a further modification, FIG. 6 is a further variation of an installation according to the invention, FIG. 7 shows part of an evaporator, and FIG. 8 is a diagram of the thermal transmission coefficient k of the evaporator against the recirculation rate R.

The refrigeration plant of FIG. 1 comprises a compressor 1 connected to a condenser 3 by way of a pressure conduit 2. A liquid conduit 4 leads to an expansion apparatus 5 with a switching valve 6 in the form of a magnetic valve. The throttle point of the expansion apparatus 5 is located in the switching valve 6. A connecting conduit 7 leads to an intermediate chamber 8 from the base of which a conduit 9 leads to an evaporator 10. The outlet 11 of the latter is connected to a liquid separator 12. Connected to the top there is a suction conduit 13 which leads back to the compressor 1.

The liquid separator 12 has a liquid chamber **12*a* and the sump 17 is separated from the intermediate chamber 8 by a wall 14. A conduit 15 passes through this intermediate wall 14 and comprises a switching valve 16. When the switching valve 16 is open, liquid can flow from the sump 17 of the liquid separator 12 into the intermediate chamber 8 that has a sump 18. The switching valve 6 is in the form of an opening valve and the switching valve 16 in the form of a closing valve. Both switching valves are provided with width-modulated pulses by a control apparatus 19 by way of a pulse conduit 20, the control apparatus including circuitry 19*a* for providing for controlling the switching valves. Accordingly, these switching valves are controllable into the open and closed condition in opposite senses, as is shown in FIG. 2 for the switching valve 16 and FIG. 3 for the switching valve 6. An operating cycle comprises the cycle period T. During this period, the switching valve 6 is opened for the time a and the switching valve 16 closed, the reverse applying for the time b. The ratio of the times a and b can be changed by the control apparatus 19**. The cycle period T is, for example, 25 s.

This leads to the following function. The evaporator 10 is supplied with so much liquid refrigerant that a marked proportion of the refrigerant at the outlet 11 of the evaporator is still in liquid form. This liquid collects in the sump 17 of the liquid separator 12. During the time b, when the switching valve 6 is closed and the switching valve 16 open, this liquid flows into the intermediate chamber 8. During the subsequent period a, when the switching valves reverse their function, this liquid is again driven from the sump 18 through the evaporator 10. Driving takes place under the pressure of the vapour formed behind the throttle point of the expansion apparatus 5 when the switching valve 6 is open, this pressure then obtaining in the intermediate chamber 8 By selecting the ratio of the periods a and b in the cycle period T, one can fix the recirculation number or rate R which is defined by the ratio of the actual amount of circulating refrigerant to that amount which would just evaporate completely in the evaporator 10. Recirculation is pulsating.

As is shown in FIG. 8, the thermal transmission coefficient k of the evaporator increases with the recirculation rate R, namely steeply near the value R=1 and with a flattening curve for larger values of R. If one sets the recirculation rate between 1.2 and 1.5, as is shown by the cross-hatched region D, a comparatively large coefficient k is obtained for a comparatively small recirculation quantity. One therefore obtains a good refrigerating effect with a liquid separator 12 and intermediate chamber 8 of small volume.

In the FIG. 4 embodiment, corresponding parts are given reference numerals increased by 100. The important difference resides in the changed switching valve 116. This possesses a fixed cylinder 121 with a covering wall 122 through which the connecting conduit 107 passes. The cylinder has valve apertures 123. A pot-shaped piston 124 may cover the valve apertures 123 with the pot walls 125, as is shown in FIG. 4. In the base 126 of the pot, there is a throttle 127. The piston 124 is biased in the open direction by a return spring 128 and in the closed direction by the pressure drop of the refrigerant flowing through the throttle 127. If, therefore, the switching valve 106 opens, the switching valve 116 goes to the closed position, and vice versa. The manner of operation is similar to that in FIG. 1.

In the embodiment of FIG. 5, reference numerals increased by 200 are employed for the same or similar parts. In this case the switching valve 216 is combined with a third switching valve 229. For this purpose, a valve tube 230 is fixed to the pot-shaped piston 224. This passes through a valve sleeve 231 provided with valve apertures 232. The latter are covered by the valve tube 230 in the open position of the switching valve 216. In the closed position of the switching valve 216, the end of the valve tube 230 cooperates with a valve seat 231. This means that the suction conduit 213 in the illustrated open position of the switching valve 216 is connected to the vapour chamber of the intermediate chamber 208 and is connected to the vapour chamber of the liquid separator 212 in the closed position of the switching valve 216. The valve apertures 223 are available entirely for the flow of liquid out of the liquid separator 212 because no refrigerant vapour is sucked through these apertures in the opposite direction.

In the embodiment of FIG. 6, the same or equivalent parts are given reference numerals increased by 300. The basic construction corresponds to that in FIG. 4. In addition, a sensor 334 is provided at the base 341 of the intermediate chamber 308 for detecting the transition of liquid to vapour. Its signal which is transmitted through a connection 320 can be processed in the control apparatus 19 in such a way that the second switching valve 306 closes when refrigerant leaves the intermediate chamber 308 in a two-phase condition.

The liquid conduit 304 is led by way of a first heat exchanger 335 which is formed at the periphery of the liquid separator 312 by convolutions of this conduit 304. The primary side of a second heat exchanger 336 is connected parallel thereto. The base of the intermediate chamber 308 is provided with a throttle passage 337, for example a thin tube, which is connected by way of an expansion valve 338 to the secondary side of the heat exchanger 336. The conduit 339 then leads to the suction conduit 313 of the compressor 301. Oil that has collected in the sump 318 can flow through this conduit together with a proportion of liquid refrigerant, the refrigerant reaching the compressor 301 as vapour after expansion and heating.

The FIG. 7 embodiment illustrates an evaporator 401 with a plurality of parallel individual passages 440. An input distributor 441 is formed at the evaporator 410 to result in one structural unit. This distributor 441 may also be made in one piece with the intermediate chamber. For example, several connecting nipples are provided at the base of the intermediate chamber.

Changes can be made to the illustrated examples in many respects without departing from the basic concept of the invention. Thus, the switching valves 6, 16 may be similarly constructed as opening or closing valves and controlled by two inverse rows of pulses. The liquid separator and intermediate chamber may be arranged in two different containers connectable by way of a conduit.

I claim:

1. A refrigeration or heat pump installation that utilizes a fluid refrigerant, comprising a liquid separator having an intermediate chamber and a liquid chamber, the liquid chamber having an upper portion and a lower portion above the intermediate chamber, a compressor, a suction conduit fluidly connecting the compressor to the upper portion of the liquid chamber, a condenser, a pressure conduit connecting the condenser to the compressor, an evaporator, a third circuit for conducting fluid from the intermediate chamber to the evaporator, a fourth conduit for conducting fluid from the evaporator to the liquid chamber and control means for controlling fluid flow from the condenser to the intermediate chamber and liquid flow from the lower portion of the liquid chamber to the intermediate chamber, the control means including first switching valve means operable between an opened and a closed position for controlling the flow of fluid from the condenser to the liquid separator, second switching valve means operable between an opened and a closed position for controlling the liquid flow to the intermediate chamber and being operated in the opposite sense from the first switching valve means, the first switching valve means including an expansion valve.

2. A refrigeration or heat installation according to claim 1, characterized in that the compressor has switching periods and that the control means includes means for operating the switching valve means at short opening and closing periods in relation to the switching periods of the compressor.

3. A refrigeration or heat installation according to claim 1, characterized int hat switching valve means and intermediate chamber at least in part define means for recirculating refrigerant to the evaporator at a recirculation rate of about 1.2 to 1.5.

4. A refrigeration or heat installation according to claim 1, characterized in that the intermediate chamber has a vapor portion and that the control means includes a third switching valve means that, when the second switching means is closed, substantially fluidly connects the upper portion of the liquid chamber to the suction conduit and when the switching valve is open, substantially connects the vapour chamber to the suction conduit.

5. A refrigeration or heat installation according to claim 1, characterized in that the liquid separator has a base that forms the base of the intermediate chamber, that the third circuit opens through the base to the intermediate chamber, and that the control means includes sensor means adjacent the base for detecting the transition of liquid to a two-phase liquid-vapor condition and in dependence thereon, influence the operation of the switching valve means.

6. A refrigeration or heat installation according to claim 1, characterized in that the second valve means includes fourth means for defining a first fluid flow path from the lower portion of the liquid chamber to the intermediate chamber and first closure means movable between a position permitting fluid flow through the first path and a second position blocking fluid flow through the first path and that the third valve means includes fifth means for defining a second fluid flow path from the upper portion of the liquid chamber to the suction conduit and second closure means mechanically connected to the first closure means and movable relative to the fifth means between a position permitting fluid flow through the second path and a second position blocking fluid flow through the second path.

7. A refrigeration or heat installation according to claim 6, characterized in that the first closure means comprises a piston, that the fifth means comprises valve sleeve having at least one aperture opening to the upper portion of liquid chamber to at least in part define the first path and that the second closure means includes a valve tube connected to the piston and passes therethrough and movable relative to the valve sleeve between a position blocking fluid flow through the sleeve aperture and a second position permitting fluid flow through the sleeve aperture.

8. A refrigeration or heat pump installation according to claim 1, characterized that the liquid separator has a periphery and that there is provided a heat exchanger adjacent to liquid separator periphery, the heat exchange having a primary side connected to the liquid conduit upstream of the expansion valve and a secondary side and means for connecting the secondary side to the intermediate chamber.

9. A refrigeration or heat pump installation according to claim 8, characterized that the heat exchanger is at least in part formed by convolutions of the liquid conduit at the periphery of the liquid separator.

10. A refrigeration or heat pump installation according to claim 8, characterized in that the liquid separator has a base that in part defines the intermediate chamber, that the last mentioned means includes a throttle opening through the base and a second expansion valve connected between the throttle and the secondary side of the heat exchanger.

11. A refrigeration or heat installation according to claim 1, characterized in that the control means includes pulse width modulation control apparatus for controlling the opening and closing of at least the first switching valve means.

12. A refrigeration or heat installation according to claim 11, characterized int hat each of the first and second switching valve means is a pulse width modulated magnetic valve that is operable with one of the same and inverted control pulses.

13. A refrigeration or heat installation according to claim 11, characterized in that the liquid separator includes an intermediate wall that defines a part of each of the liquid and intermediate chambers and that the second switching means includes a fourth conduit opening through the intermediate wall to the liquid chamber and a switching valve in the intermediate chamber for controlling liquid flow through the fourth conduit to the intermediate chamber.

14. A refrigeration or heat installation according to claim 11, characterized in that the first switching valve means is a pulse width modulated magnetic valve.

15. A refrigeration or heat installation according to claim 14, characterized in that the second switching valve means comprises a cylinder having a first aperture opening to the intermediate chamber and a second aperture opening to the lower portion of the liquid chamber, a piston mounted in the cylinder for movement between an open condition and a closed condition for controlling liquid flow through the second aperture to the first aperture, and a return spring in the cylinder for biasing the piston in an opening direction, the control means including a throttle opening to at least one of the cylinder and the intermediate chamber for creating a pressure drop to bias the piston in a closing direction, the refrigerant flowing through the throttle into one of the cylinder and the intermediate chamber.

16. A refrigeration or heat installation according to claim 14, characterized in that the liquid separator includes wall means defining a part of each of the chambers for separating the liquid chamber from the intermediate chamber and having a first aperture opening to the intermediate chamber, and that the second switching valve means comprises a cylinder opening to the first aperture and having a valving second aperture opening to the lower portion of the liquid chamber and a cover wall more remote from the wall means than the second aperture, a pot shaped piston mounted in the cylinder for movement between an open condition and a closed condition and having second wall means for control liquid flow through the second aperture to the first aperture, and a base joined to the second wall means remote from the first wall means, and a throttle in the base for controlling fluid flow through the base and a return spring in the cylinder for biasing the piston in an opening direction, the control means including a throttle opening to at least one of the cylinder and the intermediate chamber for creating a pressure drop to bias the piston in a closing direction, the refrigerant flowing through the throttle into one of the cylinder and the intermediate chamber.

* * * * *